US008763179B2

(12) United States Patent
Roysum

(10) Patent No.: US 8,763,179 B2
(45) Date of Patent: Jul. 1, 2014

(54) STOKES LITTER VICTIM HARNESS

(71) Applicant: Ronald Eric Roysum, Hopland, CA (US)

(72) Inventor: Ronald Eric Roysum, Hopland, CA (US)

( * ) Notice: Subject to any disclaimer, the term of this patent is extended or adjusted under 35 U.S.C. 154(b) by 0 days.

(21) Appl. No.: 13/857,751

(22) Filed: Apr. 5, 2013

(65) Prior Publication Data

US 2013/0263376 A1 Oct. 10, 2013

Related U.S. Application Data

(60) Provisional application No. 61/621,813, filed on Apr. 9, 2012.

(51) Int. Cl.
*A47B 1/00* (2006.01)

(52) U.S. Cl.
USPC ..... 5/628; 5/625

(58) Field of Classification Search
USPC ..... 5/625–629
See application file for complete search history.

(56) References Cited

U.S. PATENT DOCUMENTS

| | | | | |
|---|---|---|---|---|
| 1,270,107 | A * | 6/1918 | Boardman | 5/627 |
| 3,046,982 | A * | 7/1962 | Davis | 128/875 |
| 3,158,875 | A * | 12/1964 | Fletcher | 5/628 |
| 3,707,734 | A * | 1/1973 | Matthews | 5/628 |
| 5,014,724 | A * | 5/1991 | Miller | 128/870 |
| 5,179,746 | A * | 1/1993 | Rogers | 5/625 |
| 5,211,186 | A * | 5/1993 | Shoemaker et al. | 5/628 |
| 5,860,176 | A * | 1/1999 | Norberg | 5/628 |
| 6,363,936 | B1 * | 4/2002 | McCormick et al. | 128/870 |
| 6,691,351 | B1 * | 2/2004 | Wharton | 5/628 |
| 2004/0172759 | A1 * | 9/2004 | Sawatzky | 5/626 |
| 2004/0244114 | A1 * | 12/2004 | Robinette | 5/626 |
| 2008/0184488 | A1 * | 8/2008 | Fee et al. | 5/628 |
| 2010/0005593 | A1 * | 1/2010 | Bowling et al. | 5/627 |
| 2011/0179572 | A1 * | 7/2011 | Mohr et al. | 5/628 |
| 2012/0102650 | A1 * | 5/2012 | McGlynn | 5/627 |

FOREIGN PATENT DOCUMENTS

| | | | | |
|---|---|---|---|---|
| DE | 3937174 | A1 * | 5/1991 | A61G 1/003 |
| FR | 2583977 | A1 * | 1/1987 | A61G 1/013 |

* cited by examiner

*Primary Examiner* — William Kelleher
*Assistant Examiner* — Eric Kurilla

(57) ABSTRACT

A strokes litter victim harness includes a harness, a plurality of connectors, and a stokes litter. The harness is adjustably attached with the stokes litter by the plurality of connectors. The harness, which includes a bottom panel, a top leg panel, a left leg opening, and a right leg opening, provides the necessary support to the victim's body when the victim is transported from one location to another. Many different straps of the harness allow the operator of the stokes litter victim harness to adjust the left leg opening, the right leg opening, and other related spacing so that the victim can be secured within the harness.

17 Claims, 8 Drawing Sheets

STOKES LITTER VICTIM HARNESS

The current application claims a priority to the U.S. Provisional Patent application Ser. No. 61/621,813 filed on Apr. 9, 2012.

FIELD OF THE INVENTION

The present invention relates generally to an apparatus of a rescue harness. More specifically, the harness is attached with a stokes litter so that a transported victim is secured within the stokes litter.

BACKGROUND OF THE INVENTION

A stokes litter basket is used during rescue operations so that a victim can be safely transported from one location to another. If the victim suffers back injuries or neck injuries, extra precautions must be taken to ensure the safety of the victim so that further injuries may not occur during transportation. In most incidents, the victim's body moves inside the stokes litter basket during transportation, which creates more complications for the existing injuries.

It therefore an objective of the present invention to introduce a stokes litter and a harness, where the harness prevents any kind of movement of the victim within the stokes litter, so that the victim's body can be safely transported. The harness secures the victim's body from the shoulder area, waist area, and leg area, and the stokes litter stabilizes the harness by a plurality of adjustable connectors. The harness can firmly attach with stokes litter or a backboard with the plurality of adjustable connectors where the harness can be interchangeable and to completely secured within either the stokes litter or the backboard. The harness is designed with many different adjustable straps so that the harness can be adjusted according to different types of body structures.

DETAIL DESCRIPTIONS OF THE INVENTION

All illustrations of the drawings are for the purpose of describing selected versions of the present invention and are not intended to limit the scope of the present invention.

The present invention is a stokes litter victim harness which comprises a harness 1, a plurality of connectors 6, and a stokes litter 7. The present invention provides a secured transportation environment for a victim so that the victim can be safely transported into from one location to another. In reference to FIG. 1, the harness 1 secures the victim's body within the stokes litter 7 during transportation, where the harness 1 is adjustably secured to the stokes litter 7 by the plurality of connectors 6. The stokes litter 7 functions as the transportation vessel for the victim as the stokes litter 7 can be carried by the emergency crews or can be connected with any kind of transporting means.

Figure 1:
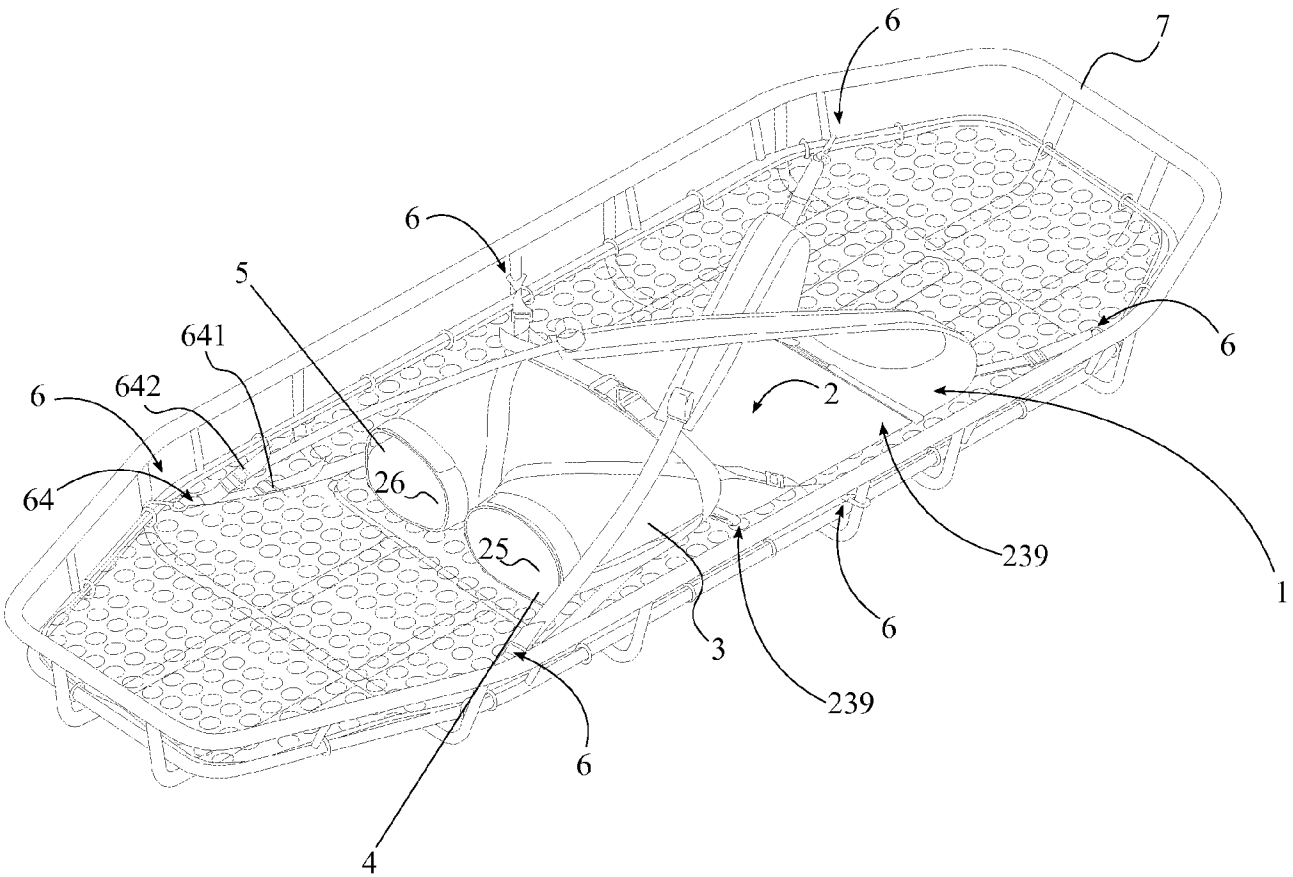
FIG. 1 is a left perspective view of the present invention.
Figure 2:
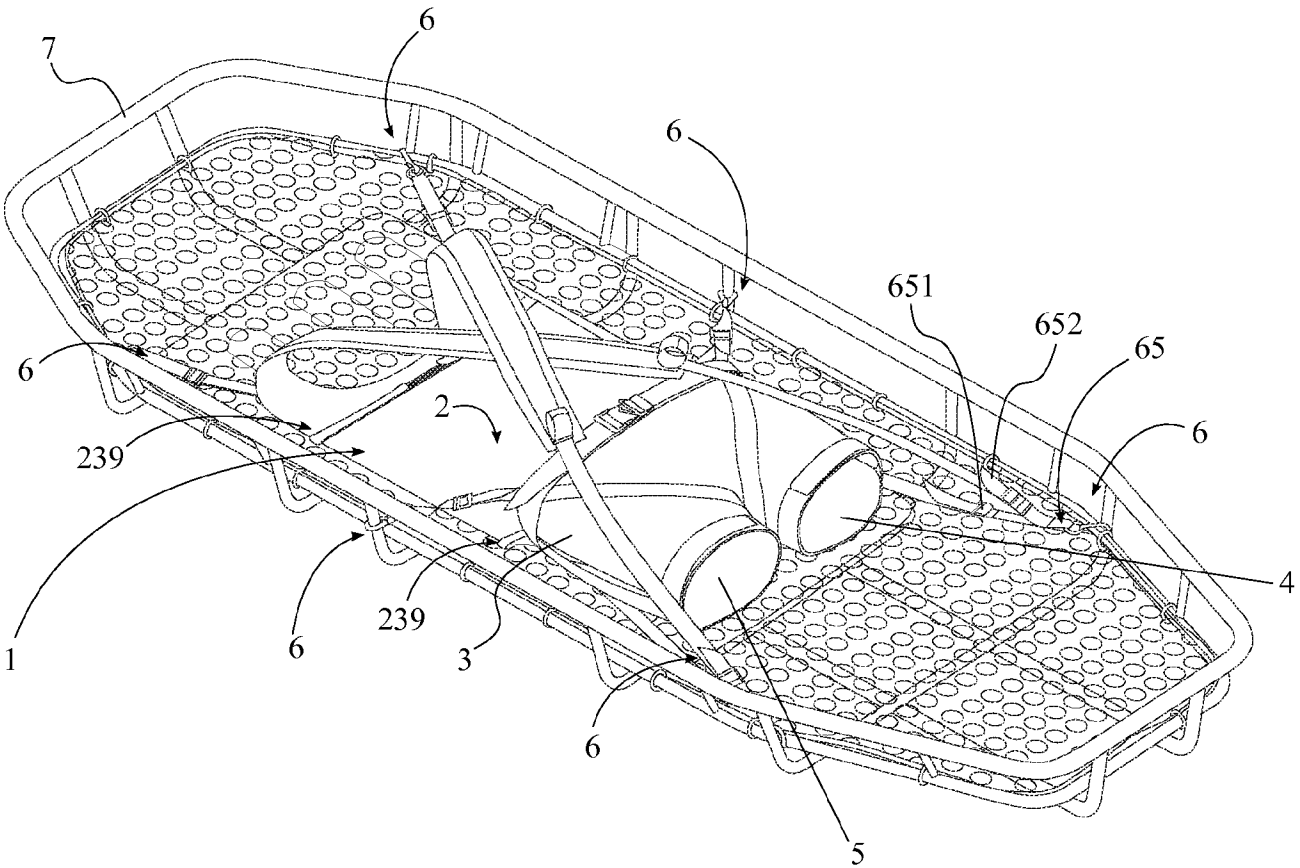
FIG. 2 is a right perspective view of the present invention.

In reference to FIG. 1 and FIG. 2, the harness 1 comprises a bottom panel 2, a top leg panel 3, a left leg opening 4, and a right leg opening 5. When the victim is positioned within the harness 1, the bottom panel 2 places underneath the back of the victim, the top leg panel 3 places over the legs of the victim, and the left leg opening 4 and the right leg opening 5 are respectively positioned around the left leg of the victim and the right leg of the victim.

Figure 3:
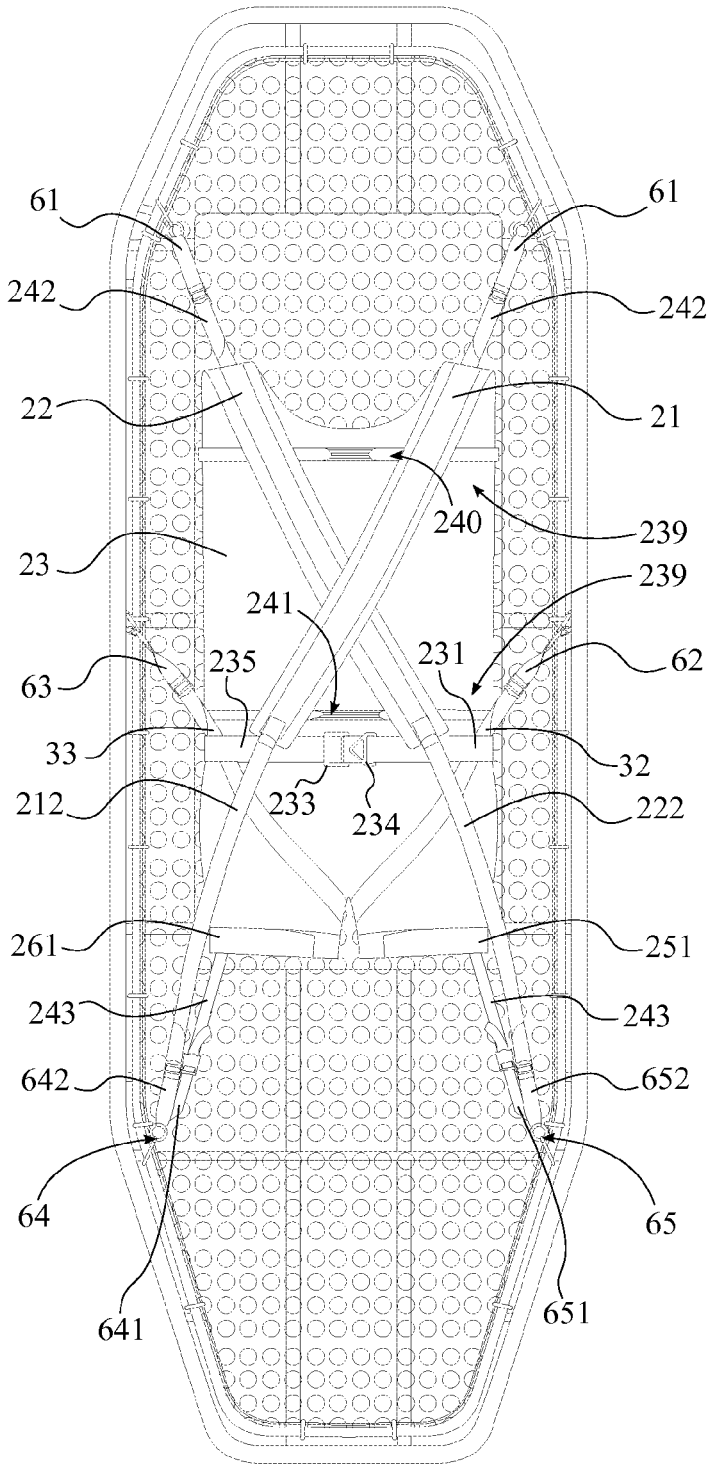
FIG. 3 is a top view of the present invention.
Figure 4:
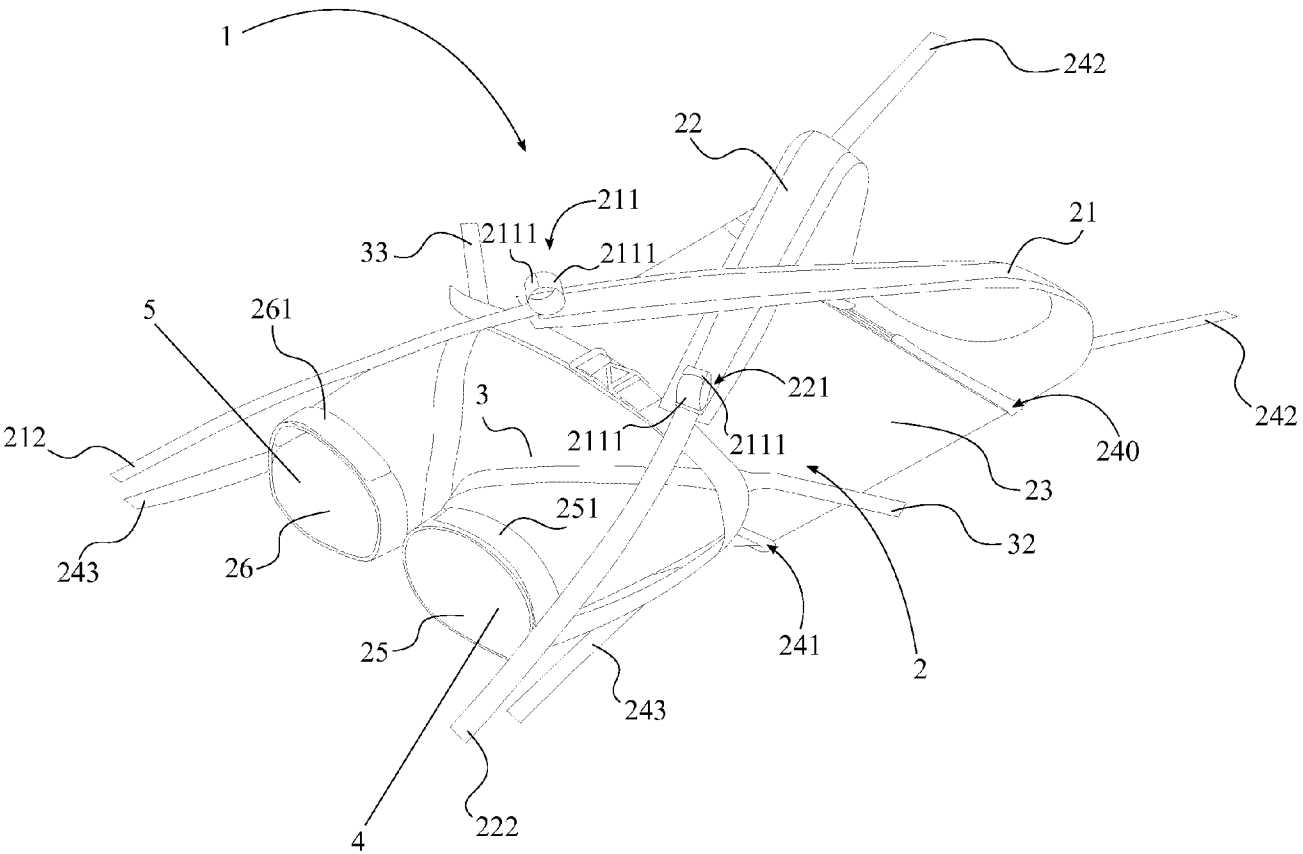
FIG. 4 is a left perspective view of a harness of the present invention, wherein all the straps are closed.

In reference to FIG. 3 and FIG. 4, the bottom panel 2 comprises a left shoulder strap 21, a right shoulder strap 22, a back portion 23, a left leg portion 25, and a right leg portion 26. The left leg portion 25 is oppositely positioned from the right leg portion 26, and the back portion 23 is adjacently positioned with the left leg portion 25 and the right leg portion 26. The left leg portion 25 supports the rear side of the victim's left leg and the left side of the victim's buttocks. The right leg portion 26 supports the rear side of the victim's right leg and the right side of the victim's buttocks. The back portion 23 supports the back and the spinal codes of the victim. The left shoulder strap 21 and the right shoulder strap 22 are adjacently positioned with the back portion 23, where the left shoulder strap 21 and the right shoulder strap 22 are oppositely positioned from the left leg portion 25 and the right leg portion 26. The left shoulder strap 21 and the right shoulder strap 22 are oppositely positioned from each other in a way that the left shoulder strap 21 aligns with the left leg portion 25, and the right shoulder strap 22 aligns with the right leg portion 26. The left shoulder strap 21 and the right shoulder strap 22 support the upper body of the victim as the left shoulder strap 21 and the right shoulder strap 22 curve over the shoulders of the victim and cross over the upper body of the victim. The left shoulder strap 21 and the right shoulder strap 22 are crisscrossed over the upper body of the victim creating a secured environment for the upper body of the victim.

The top leg panel 3 is positioned atop the left leg portion 25 and the right leg portion 26, creating the left leg opening 4 and the right leg opening 5. More specifically, the left leg opening 4 is positioned in between the left leg portion 25 and the top leg panel 3, and the right leg opening 5 is positioned in between the right leg portion 26 and the top leg panel 3. The top leg panel 3 is connected to the bottom panel 2 in between the left leg opening 4 and the right leg opening 5 so that the top leg panel 3 does not separate from the bottom panel 2.

In reference to FIG. 4, the left shoulder strap 21 comprises a first loop 211 and a first attachment strap 212. The first attachment strap 212 is connected along the left shoulder strap 21 and extends beyond a free extremity of the left shoulder strap 21. The first attachment strap 212 secures the left shoulder strap 21 within the present invention. The first loop 211 is connected to the first attachment strap 212 and the left shoulder strap 21, where the first loop 211 secures the left forearm of the victim. The first loop 211 comprises a pair of adjustable loop straps 2111, and the pair of adjustable loop straps 2111 is attached to each other by a detachable fastener. Even though the preferred embodiment of the present invention utilizes a hook-and-loop fastener as the detachable fastener in the first loop 211, any other type of detachable fasteners such as, buttons and button holes, zippers, locking clips can be used within the present invention.

In reference to FIG. 4, the right shoulder strap 22 comprises a second loop 221 and a second attachment strap 222. The second attachment strap 222 is connected along the right shoulder strap 22 and extends beyond a free extremity of the right shoulder strap 22. The second attachment strap 222 secures the right shoulder strap 22 within the present invention. The second loop 221 is connected to the second attachment strap 222 and the right shoulder strap 22, where the second loop 221 secures the right forearm of the victim. The second loop 221 comprises a pair of adjustable loop straps 2111, and the pair of adjustable loop straps 2111 is attached to each other by a detachable fastener. Even though the preferred embodiment of the present invention utilizes a hook-and-loop fastener as the detachable fastener in the second loop 221, any other type of detachable fasteners such as, buttons and button holes, zippers, locking clips can be used within the present invention.

The back portion 23 comprises a left waist strap 231, a left waist loop fastener strip 232, a buckle 233, a hook 234, a right waist strap 235, an underside right waist loop fastener strip 236, a top right waist loop fastener strip 237, a top right waist hook fastener strip 238, a plurality of backboard fasteners 239, a pair of top connecting straps 242, and a pair of lower connecting straps 243.

Figure 5:
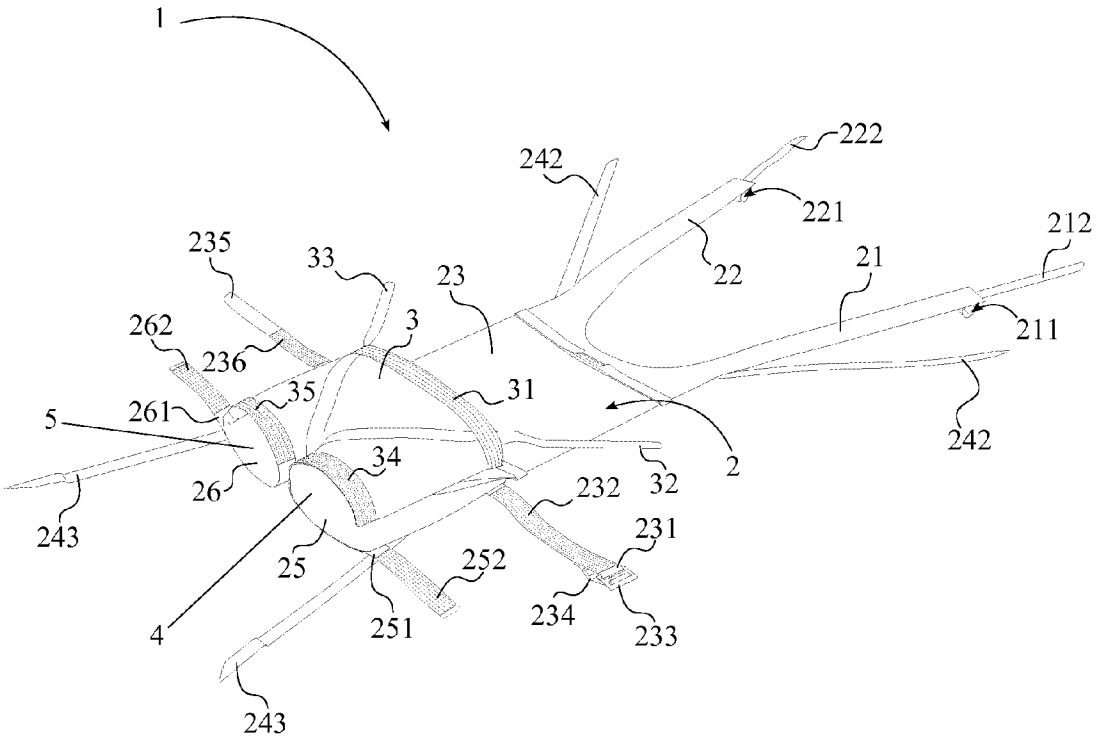
FIG. 5 is a left perspective view of the harness of the present invention, wherein all the straps are opened.

In reference to FIG. 3 and FIG. 5, the left waist strap 231 is connected to the back portion 23, where the left waist strap 231 is positioned in between the left shoulder strap 21 and the left leg portion 25. The left waist strap 231 secures the left waist area of the victim within the present invention. The left waist loop fastener strip 232 is connected to the left waist strap 231 along the length of the left waist strap 231. The buckle 233 is pivotally connected to the left waist strap 231. More specifically, the buckle 233 is pivotally connected to a free end of the left waist strap 231. The hook 234 is adjacently positioned with the buckle 233 and connected to the left waist strap 231, where the hook 234 is oppositely positioned from the left waist loop fastener strip 232.

Figure 6:
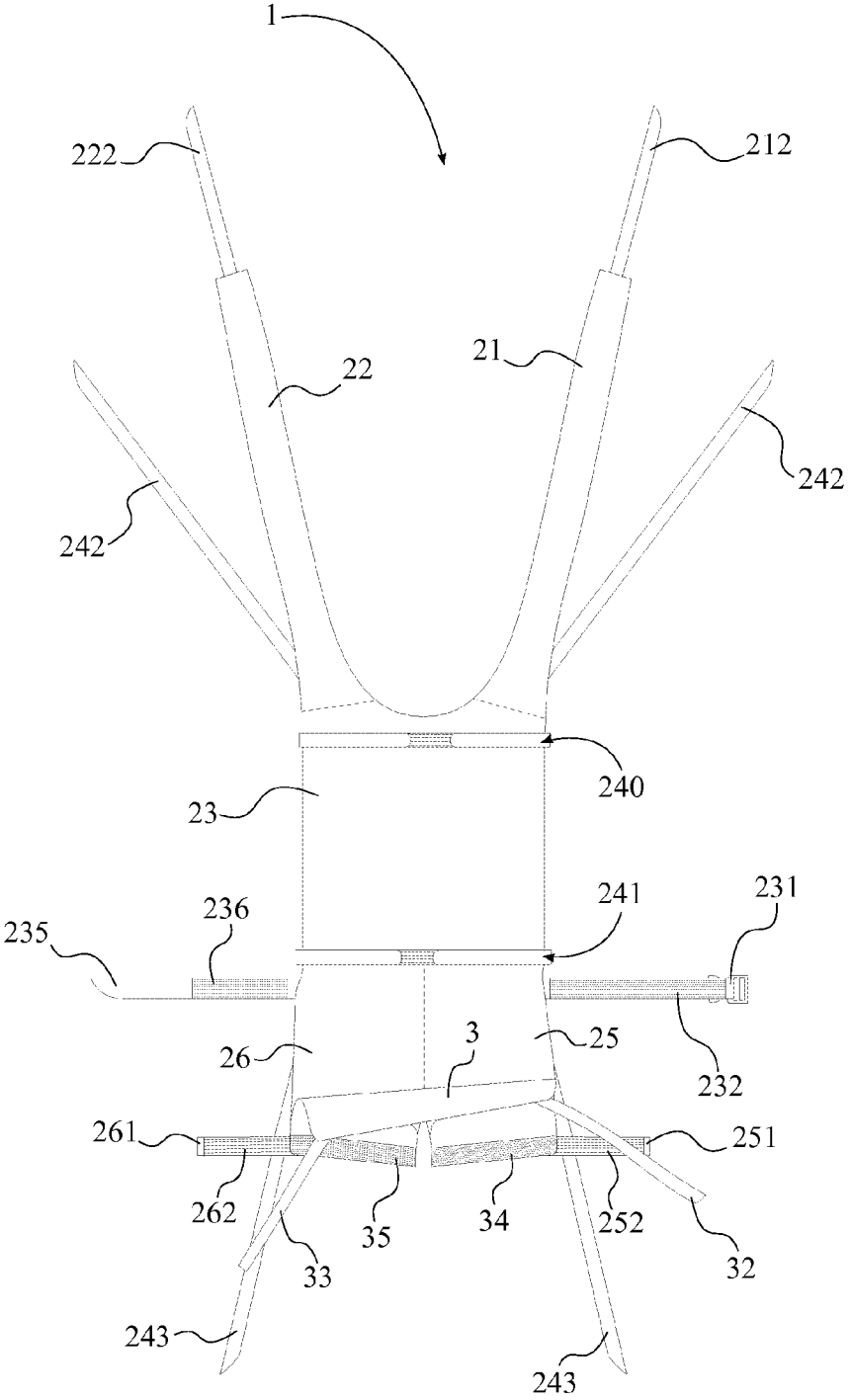
FIG. 6 is a top view of the harness of the present invention, wherein all the straps and a top leg panel are opened.
Figure 7:
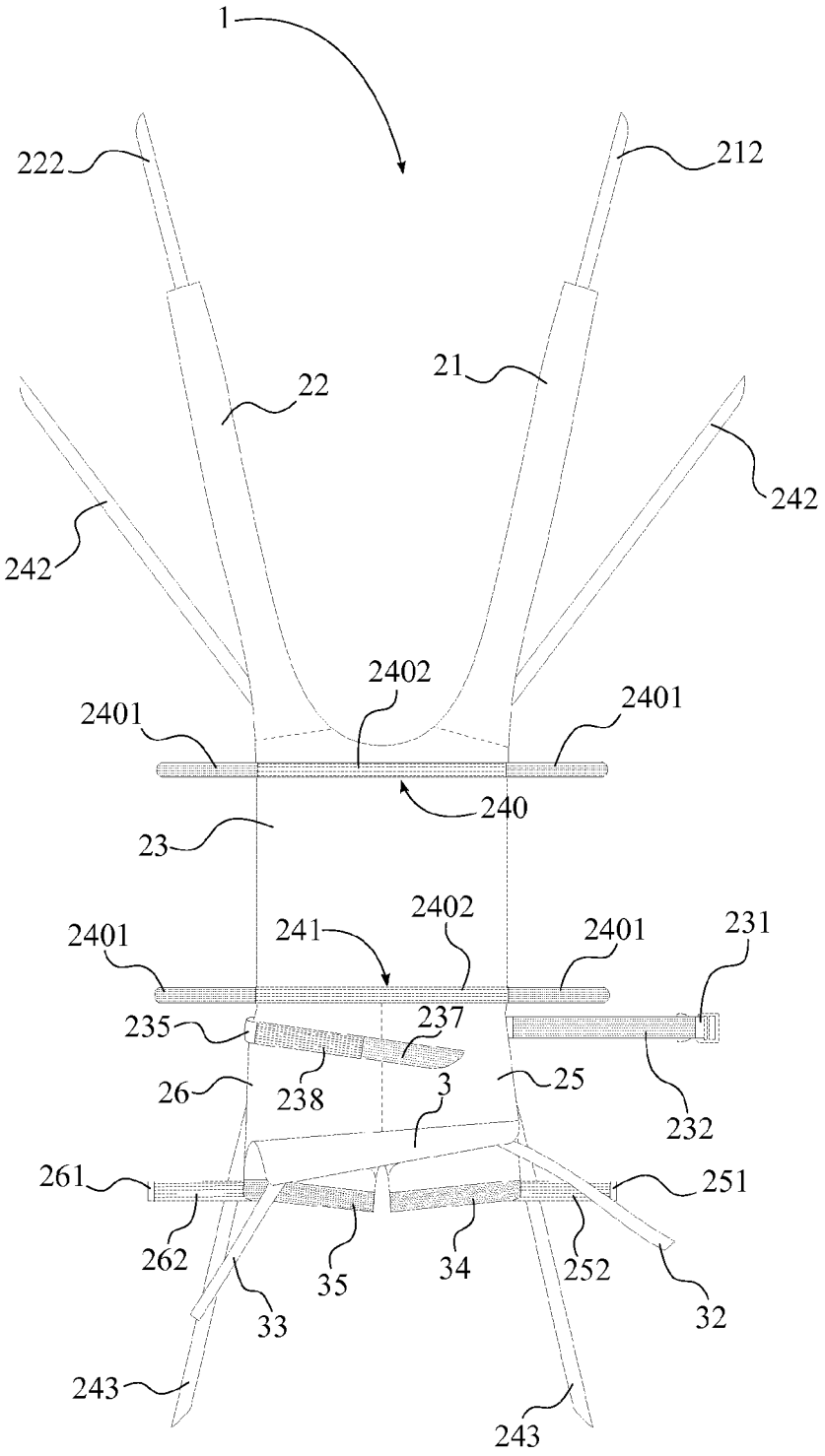
FIG. 7 is a top view of the harness of the present invention, wherein a plurality of backboard fasteners is opened and a top side of a right waist strap is illustrated.

In reference to FIG. 6 and FIG. 7, the right waist strap 235 is connected to the back portion 23, where the right waist strap 235 is positioned in between the right shoulder strap 22 and the right leg portion 26. The right waist strap 235 secures the right waist area of the victim within the present invention. The underside right waist loop fastener strip 236 is connected to the right waist strap 235 along the length of the right waist strap 235. The top right waist loop fastener strip 237 and the top right waist hook fastener strip 238 are connected along the right waist strap 235, where the top right waist loop fastener strip 237 and the top right waist hook fastener strip 238 are oppositely positioned from the underside right waist loop fastener strip 236 and from each other. The top right waist hook fastener strip 238 is adjacently positioned with the back portion 23. The top right waist loop fastener strip 237 is adjacently positioned with the top right waist hook fastener strip 238 along the right waist strap 235 and adjacently positioned with a free end of the right waist strap 235.

In reference to FIG. 3, the plurality of backboard fasteners 239, which comprises a first hook-and-loop fastener 240 and a second hook-and-loop fastener 241, is connected on the back portion 23. When the harness 1 needs to be attached with a backboard, the plurality of backboard fasteners 239 is used to secure the harness 1 with the backboard. The first hook-and-loop fastener 240 is adjacently positioned with the left shoulder strap 21 and the right shoulder strap 22. The second hook-and-loop fastener 241 is adjacently positioned with the left waist strap 231 and the right waist strap 235. In reference to FIG. 7, the first hook-and-loop fastener 240 and the second hook-and-loop fastener 241 each comprises a pair of loop fastener straps 2401 and a hook fastener liner 2402. The hook fastener liner 2402 is connected cross the back portion 23 from left to right, and the pair of loop fastener straps 2401 is connected to the back portion 23. The pair of loop fastener straps 2401 is oppositely positioned from each other along the hook fastener liner 2402, where the pair of loop fastener straps 2401 is adjustably attached with the hook fastener liner 2402. When the harness 1 needs to be attached with the backboard, the pair of loop fastener straps 2401 of the first hook-and-loop fastener 240 and the second hook-and-loop fastener 241 are inserted though gaps of the backboard and attached with the hook fastener liner 2402 of the first hook-and-loop fastener 240 and the second hook-and-loop fastener 241 so that the harness 1 can be securely attached with the backboard.

Figure 8:
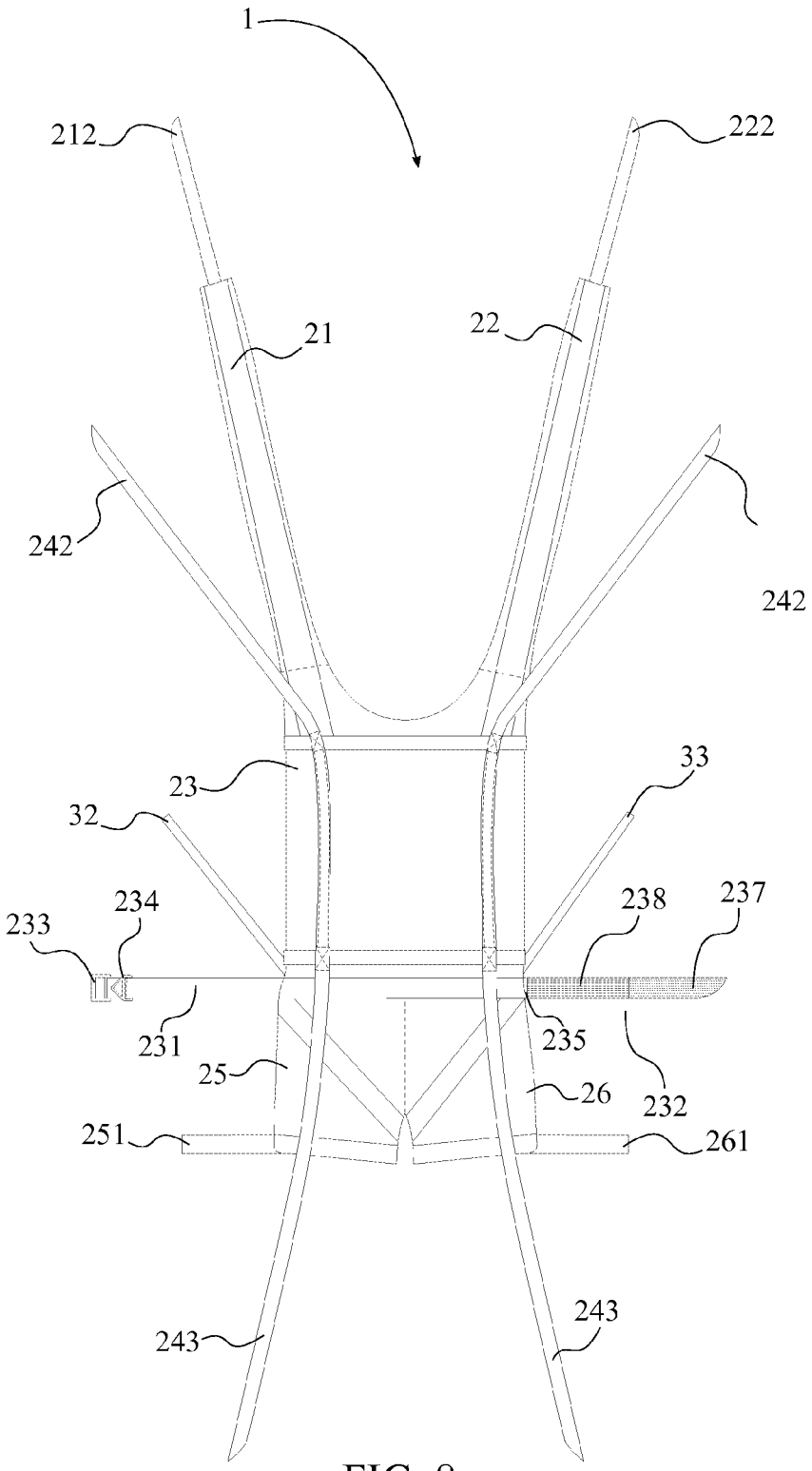
FIG. 8 is a back view of the harness of the present invention.

In reference to FIG. 3, FIG. 7, and FIG. 8, the pair of top connecting straps 242 is connected to the back portion 23, where the pair of top connecting straps 242 is oppositely positioned from the plurality of backboard fasteners 239. The pair of top connecting straps 242 extends toward the left shoulder strap 21 and the right shoulder strap 22. The pair of top connecting straps 242 secures the harness 1 to the stokes litter 7 from the head area of the victim. The pair of lower connecting straps 243 is connected to the back portion 23, where the pair of lower connecting straps 243 is oppositely positioned from the plurality of backboard fasteners 239. The pair of lower connecting straps 243 extends toward the left leg portion 25 and the right leg portion 26. The pair of lower connecting straps 243 secures the harness 1 to the stokes litter 7 from the leg area of the victim.

In reference to FIG. 5, the left leg portion 25 comprises a left leg strap 251 and a left leg hook fastener strip 252. The left leg strap 251 is connected to the left leg portion 25 and adjacently positioned with the left leg opening 4, where the left leg strap 251 adjusts the left leg opening 4 and secures the left leg of the victim. The left leg hook fastener strip 252 is connected along the left leg strap 251. The right leg portion 26 comprises a right leg strap 261 and a right leg hook fastener strip 262. The right leg strap 261 is connected to the right leg portion 26 and adjacently positioned with the right leg opening 5, where the right leg strap 261 adjusts the right leg opening 5 and secures the right leg of the victim. The right leg hook fastener strip 262 is connected along the right leg strap 261.

In reference to FIG. 5, the top leg panel 3 comprises a waist hook fastener strip 31, a left waist attachment strap 32, a right waist attachment strap 33, a left leg panel loop fastener strip 34, and a right leg panel loop fastener strip 35. The left leg panel loop fastener strip 34 is connected to the top leg panel 3, where the left leg panel loop fastener strip 34 is adjacently positioned with the left leg opening 4. The right leg panel loop fastener strip 35 is connected to the top leg panel 3, where the right leg panel loop fastener strip 35 is adjacently positioned with the right leg opening 5. The waist hook fastener strip 31 is connected to the top leg panel 3, and the waist hook fastener strip 31 is oppositely positioned from the left leg panel loop fastener strip 34 and the right leg panel loop fastener strip 35. The waist hook fastener strip 31, the left leg panel loop fastener strip 34, and the right leg panel loop fastener strip 35 allow the top leg panel 3 to attach with the bottom panel 2. The left waist attachment strap 32 is positioned in between the waist hook fastener strip 31 and the top leg panel 3 and connected to the waist hook fastener strip 31 and the top leg panel 3. The left waist attachment strap 32 extends toward the left waist strap 231, where the left waist attachment strap 32 attaches the left side of the top leg panel 3 with the stokes litter 7. The right waist attachment strap 33 is positioned in between the waist hook fastener strip 31 and the top leg panel 3 and connected to the waist hook fastener strip 31 and the top leg panel 3. The right waist attachment strap 33 extends toward the right waist strap 235, where the right waist attachment strap 33 attaches the right side of the top leg panel 3 with the stokes litter 7.

In reference to FIG. 3, the plurality of connectors 6 comprises a pair of top connectors 61, a left waist connector 62, a right waist connector 63, a first dual connector 64, and a second dual connector 65. The plurality of connectors 61 functions as the connection point between the harness 1 and the stokes litter 7 so that the harness 1 can be secured within the stokes litter 7. The pair of top connectors 61 is adjacently positioned with the left shoulder strap 21 and the right shoulder strap 22, where the pair of top connectors 61 removably attached with the stokes litter 7. Since the harness 1 is placed within the stokes litter 7, the pair of top connecting straps 242 adjustably attaches with the pair of top connectors 61, completely restricting the vertical and horizontal movement around the shoulder area of the victim. The left waist connector 62 is adjacently positioned with the left waist strap 231 and removably attached with the stokes litter 7. The right waist connector 63 is adjacently positioned with the right waist strap 235 and removably attached with the stokes litter 7. The left waist attachment strap 32 and the right waist attachment strap 33 are adjustably and respectively attached with the left waist connector 62 and the right waist connector 63 so that horizontal movement of the harness 1 around the waist of the victim can be completely eliminated from the present invention.

In reference to FIG. 1, FIG. 2, and FIG. 3, the first dual connector 64 and the second dual connector 65 are oppositely positioned from the pair of top connectors 61 and removably attached with the stokes litter 7. The first dual connector 64, which comprises a first lower connector 641 and a first attachment connector 642, is adjacently positioned with the right leg opening 5, and the first lower connector 641 and the first attachment connector 642 are connected to each other. The second dual connector 65, which comprises a second lower connector 651 and a second attachment connector 652, is adjacently positioned with the left leg opening 4, and the second lower connector 651 and the second attachment connector 652 are connected to each other. Since the harness 1 is placed within the stokes litter 7, the pair of lower connecting straps 243 adjustably attaches with the pair of lower connectors, completely restricting the vertical and horizontal movement around the leg area of the victim.

When the victim is placed within the harness 1, the left leg strap 251 is positioned over the left leg opening 4 and attached with the top leg panel 3. More specifically, the left leg hook fastener strip 252 is adjustably attached with the left leg panel loop fastener strip 34, allowing the operator of the present invention to securely place the left leg of the victim within the harness 1. Then the right leg strap 261 is positioned over the right leg opening 5 and attached with the top leg panel 3. More specifically, the right leg hook fastener strip 262 is adjustably attached with the right leg panel loop fastener strip 35, allowing the operator of the present invention to securely place the right leg of the victim within the harness 1.

Then the left waist strap 231 and the right waist strap 235 are positioned over the top leg panel 3, attaching the bottom panel 2 with the top leg panel 3 so that the waist of the victim can be securely placed within the harness 1. More specifically, the left waist loop fastener strip 232 is adjustably attached with the waist hook fastener strip 31, where the hook 234 is faced toward the operator. Then the underside right waist loop fastener strip 236 is adjustably attached with the waist hook fastener strip 31, and the free end of the right waist strap 235 is inserted through the buckle 233 and directed away from the left waist strap 231. Then the top right waist loop fastener strip 237 is adjacently and adjustably attached with the top right waist hook fastener strip 238.

The left shoulder strap 21 is then crossed over the back portion 23, securing the upper body of the victim in between the back portion 23 and the left shoulder strap 21, and then the first attachment strap 212 is adjustably attached with the first attachment connector 642. The right shoulder strap 22 is then crossed over the back portion 23, securing the upper body of the victim in between the back portion 23 and the right shoulder strap 22, and then the second attachment strap 222 is adjustably attached with the second attachment connector 652. Then the left forearm of the victim is placed within the first loop 211, and the left forearm is secured within the first loop 211 by the pair of adjustable loop straps 2111 of the first loop 211. Then the right forearm of the victim is placed within the second loop 221, and the right forearm is secured within the second loop 221 by the pair of adjustable loop straps 2111 of the first loop 211.

Although the invention has been explained in relation to its preferred embodiment, it is to be understood that many other possible modifications and variations can be made without departing from the spirit and scope of the invention as hereinafter claimed.

What is claimed is:

1. A stokes litter victim harness comprises:

a harness;

a plurality of connectors;

a stokes litter;

the harness comprises a bottom panel, a top leg panel, a left leg opening, and a right leg opening;

the bottom panel comprises a left shoulder strap, a right shoulder strap, a back portion, a left leg portion, and a right leg portion;

the left shoulder strap comprises a first loop and a first attachment strap;

the right shoulder strap comprises a second loop and a second attachment strap;

the back portion comprises a left waist strap, a left waist loop fastener strip, a buckle, a hook, a right waist strap, an underside right waist loop fastener strip, a top right waist loop fastener strip, a top right waist hook fastener strip, a plurality of backboard fasteners, a pair of top connecting straps, and a pair of lower connecting straps;

the left leg portion comprises a left leg strap and a left leg hook fastener strip;

the right leg portion comprises a right leg strap and a right leg hook fastener strip;

the top leg panel comprises a waist hook fastener strip, a left waist attachment strap, a right waist attachment strap, a left leg panel loop fastener strip, and a right leg panel loop fastener strip;

the plurality of connectors comprises a pair of top connectors, a left waist connector, a right waist connector, a first dual connector, and a second dual connector;

the first dual connector comprises a first lower connector and a first attachment connector;

the second dual connector comprises a second lower connector and a second attachment connector;

the harness being positioned within the stokes litter;

the first attachment strap being connected along the left shoulder strap;

the first attachment strap being extended beyond the left shoulder strap; and the first loop being connected to the first attachment strap and the left shoulder strap.

2. The stokes litter victim harness as claimed in claim 1 comprises:

the left leg portion being oppositely positioned from the right leg portion;

the top leg panel being positioned atop the left leg portion and the right leg portion;

the left leg opening being positioned in between the left leg portion and the top leg panel the right leg opening being positioned in between the right leg portion and the top leg panel;

the back portion being adjacently positioned with the left leg portion and the right leg portion;

the left shoulder strap and the right shoulder strap being adjacently positioned with the back portion opposite from the left leg portion and the right leg portion; and the left shoulder strap and the right shoulder strap being oppositely positioned form each other.

3. The stokes litter victim harness as claimed in claim 2 comprises:

the top leg panel being connected to the bottom panel in between the left leg opening and the right leg opening.

4. The stokes litter victim harness as claimed in claim 1 comprises:

the first loop comprises a pair of adjustable loop straps; and the pair of adjustable loop straps being attached to each other.

5. The stokes litter victim harness as claimed in claim 1 comprises:

the second attachment strap being connected along the right shoulder strap;

the second attachment strap being extended beyond the right shoulder strap; and the second loop being connected to the second attachment strap and the right shoulder strap.

6. The stokes litter victim harness as claimed in claim 5 comprises:

the second loop comprises a pair of adjustable loop straps; and the pair of adjustable loop straps being attached to each other.

7. The stokes litter victim harness as claimed in claim 1 comprises:

the left waist strap being connected to the back portion;

the left waist strap being positioned in between the left shoulder strap and the left leg portion;

the left waist loop fastener strip being connected to the left waist strap;

the buckle being pivotally connected to the left waist strap;

the hook being oppositely positioned from the left waist loop fastener strip;

the hook being connected to the left waist strap;

the right waist strap being connected to the back portion;

the right waist strap being positioned in between the right shoulder strap and the right leg portion;

the underside right waist loop fastener strip being connected to the right waist strap;

the top right waist loop fastener strip and the top right waist hook fastener strip being connected along the right waist strap;

the top right waist loop fastener strip and the top right waist hook fastener strip being oppositely positioned from the underside right waist loop fastener strip;

the top right waist hook fastener strip being adjacently positioned with the back portion; and the top right waist loop fastener strip being adjacently positioned with the top right hook fastener strip along the right waist strap.

8. The stokes litter victim harness as claimed in claim 1 comprises:

the plurality of backboard fasteners being connected on the back portion;

the pair of top connecting straps and the pair of lower connecting straps being connected with the back portion;

the pair of top connecting straps and the pair of lower connecting straps being oppositely positioned from the plurality of backboard fasteners;

the pair of top connecting straps being extended toward the left shoulder strap and the right shoulder strap; and the pair of lower connecting straps being extended toward the left leg portion and the right leg portion.

9. The stokes litter victim harness as claimed in claim 8 comprises:

the plurality of backboard fasteners comprises a first hook-and-loop fastener and a second hook-and-loop fastener;

the first hook-and-loop fastener being adjacently positioned with the left shoulder strap and the right shoulder strap; and the second hook-and-loop fastener being adjacently positioned with the left waist strap and the right waist strap.

10. The stokes litter victim harness as claimed in claim 9 comprises:

the first hook-and-loop fastener and the second hook-and-loop fastener each comprises a pair of loop fastener straps and a hook fastener liner;

the hook fastener liner being connected cross the back portion;

the pair of loop fastener straps being connected to the back portion;

the pair of loop fastener straps being oppositely positioned from each other along the hook fastener liner; and the pair of loop fastener straps being adjustably attached with the hook fastener liner.

11. The stokes litter victim harness as claimed in claim 1 comprises:

the left leg strap being connected to the left leg portion;

the left leg strap being adjacently positioned with the left leg opening; and the left leg hook fastener strip being connected along the left leg strap.

12. The stokes litter victim harness as claimed in claim 1 comprises:

the right leg strap being connected to the right leg portion;

the right leg strap being adjacently positioned with the right leg opening; and the right leg hook fastener strip being connected along the right leg strap.

13. The stokes litter victim harness as claimed in claim 1 comprises:

the left leg panel loop fastener strip being connected to the top leg panel the left leg panel loop fastener strip being adjacently positioned with the left leg opening;

the right leg panel loop fastener strip being connected to the top leg panel the right leg panel loop fastener strip being adjacently positioned with the right leg opening;

the waist hook fastener strip being connected on the top leg panel;

the waist hook fastener strip being oppositely positioned from the left leg panel loop fastener strip and the right leg panel loop fastener strip;

the left waist attachment strap being connected to the waist hook fastener strip and the top leg panel;

the left waist attachment strap being positioned in between the waist hook fastener strip and the top leg panel;

the left waist attachment strap being extended toward the left waist strap;

the right waist attachment strap being connected to the waist hook fastener strip and the top leg panel;

the right waist attachment strap being positioned in between the waist hook faster strip and the top leg panel; and the right waist attachment strap being extended toward the right waist strap.

14. The stokes litter victim harness as claimed in claim 1 comprises:

the left leg strap being positioned over the left leg opening;

the left leg hook fastener strip being adjustably attached with the left leg panel loop fastener strip, wherein the left leg strap adjusts the left leg opening;

the right leg strap being positioned over the right leg opening;

the right leg hook fastener strip being adjustably attached with the right leg panel loop fastener strip, wherein the right leg strap adjusts the right leg opening;

the left waist strap and the right waist strap being positioned over the top leg panel, wherein the left waist strap and the right waist strap adjust the space in between the bottom panel and the top leg panel;

the left waist loop fastener strip being adjustably attached with the waist hook fastener strip;

the underside right waist loop fastener strip being adjustably attached with the waist hook fastener strip;

the right waist strap being inserted through the buckle, wherein the right waist strap is directed away from the left waist strap; and the top right waist loop fastener strip being adjacently and adjustably attached with the top right waist hook fastener strip.

15. The stokes litter victim harness as claimed in claim 1 comprises:

the pair of top connectors being attached with the stokes litter;

the pair of top connectors being adjacently positioned with the left shoulder strap and the right shoulder strap;

the left waist connector and the right waist connector being attached with the stokes litter;

the left waist connector being adjacently positioned with the left waist strap;

the right waist connector being adjacently positioned with the right waist strap;

the first dual connector and the second dual connector being attached with the stokes litter;

the first dual connector being adjacently positioned with the right leg opening; and the second dual connector being adjacently positioned with the left leg opening.

16. The stokes litter victim harness as claimed in claim 15 comprises:

the first lower connector and the first attachment connector being connected to the each other; and the second lower connector and the second attachment connector being connected to the each other.

17. The stokes litter victim harness as claimed in claim 1 comprises:

the pair of top connecting straps being adjustably attached with the pair of top connectors;

the pair of lower connecting straps being adjustably attached with the first lower connector and the second lower connector;

the left waist attachment strap being adjustably attached with the left waist connector;

the right waist attachment strap being adjustably attached with the right waist connector;

the first attachment strap being adjustably attached with the first attachment connector, wherein the left shoulder strap is crossed over the back portion; and the second attachment strap being adjustably attached with the second attachment connector, wherein the right shoulder strap is crossed over the back portion.

* * * * *